US011692321B2

(12) United States Patent
Strait et al.

(10) Patent No.: US 11,692,321 B2
(45) **Date of Patent: *Jul. 4, 2023**

(54) SALT SPREADER ATTACHABLE TO EARTH MOVING EQUIPMENT

(71) Applicants: Randy Strait, Frankfort, IL (US); Blake Strait, Lowell, IN (US)

(72) Inventors: Randy Strait, Frankfort, IL (US); Blake Strait, Lowell, IN (US)

( * ) Notice: Subject to any disclaimer, the term of this patent is extended or adjusted under 35 U.S.C. 154(b) by 46 days.

This patent is subject to a terminal disclaimer.

(21) Appl. No.: 17/379,599

(22) Filed: Jul. 19, 2021

(65) Prior Publication Data

US 2021/0348350 A1 Nov. 11, 2021

Related U.S. Application Data

(63) Continuation of application No. 16/440,672, filed on Jun. 13, 2019, now Pat. No. 11,066,797.

(60) Provisional application No. 62/684,739, filed on Jun. 13, 2018.

(51) Int. Cl.
*E01H 10/00* (2006.01)
*E01C 19/20* (2006.01)

(52) U.S. Cl.
CPC ..... *E01H 10/007* (2013.01); *E01C 19/203* (2013.01); *E01C 2019/208* (2013.01); *E01C 2019/209* (2013.01)

(58) Field of Classification Search
CPC ..... E01H 10/007; E01C 19/20; E01C 19/201; E01C 19/202; E01C 19/203; E01C 2019/208; E01C 2019/209
See application file for complete search history.

(56) References Cited

U.S. PATENT DOCUMENTS 2,421,211 A * 5/1947 Wilmer ..... A01C 17/00 239/657
2,947,544 A * 8/1960 Hurt ..... A01C 15/006 222/627
4,836,456 A * 6/1989 van der Lely ..... A01C 17/00 239/665
5,927,617 A * 7/1999 Musso, Jr. ..... F04B 17/06 239/657
5,957,394 A * 9/1999 Becker ..... A01K 5/002 239/689
5,988,535 A * 11/1999 Kime ..... E01H 10/007 239/650

(Continued)

*Primary Examiner* — Darren W Gorman
(74) *Attorney, Agent, or Firm* — K&L Gates LLP

(57) ABSTRACT

A salt spreader for distributing a material includes a bucket including a front surface, a rear surface, and first and second side surfaces. The front and rear surfaces tend toward one another at a base of the bucket, and the bucket includes first and second ejection ports in the base. The salt spreader further includes a separator positioned in a center of the bucket parallel to the first and second side surfaces, first and second spinner mounts attached to the base of the bucket under the first and second ejection ports, respectively, first and second spinners rotatably mounted atop of the first and second spinner mounts, respectively, an auger positioned adjacent to the base of the bucket, and first and second covers within the bucket extending downwardly from the first and second side surfaces, respectively, toward the separator.

8 Claims, 10 Drawing Sheets

(56) References Cited

U.S. PATENT DOCUMENTS

| | | | | |
|---|---|---|---|---|
| 6,648,250 | B2 * | 11/2003 | Garnett | A01C 3/06 239/658 |
| 2003/0098373 | A1 * | 5/2003 | Smith | E01C 19/203 239/668 |
| 2010/0044473 | A1 * | 2/2010 | Truan | A01C 15/18 239/675 |
| 2015/0330045 | A1 * | 11/2015 | Kime | A01C 17/001 239/681 |
| 2017/0339918 | A1 * | 11/2017 | Becker | B01F 27/70 |

* cited by examiner

SALT SPREADER ATTACHABLE TO EARTH MOVING EQUIPMENT

CROSS-REFERENCE TO RELATED APPLICATION

This application is a continuation application of U.S. Ser. No. 16/440,672 filed Jun. 13, 2019, which claims the benefit of priority to U.S. Provisional Application No. 62/684,739 filed on Jun. 13, 2018, the disclosure of which is incorporated herein by reference.

BACKGROUND OF THE INVENTION

The present subject matter relates generally to a salt spreader attachable to earth moving equipment. More specifically, the present invention relates to a salt spreader including a bucket having ejection ports and spinner controls along a bottom surface to dispense and distribute rock salt onto surrounding surfaces at low elevations.

During wintry conditions, a salt truck is typically used to distribute rock salt onto roads and parking lots to melt ice and improve driving and walking conditions. The salt truck stores rock salt in a large hopper on the rear of the vehicle. The hopper feeds the rock salt through an impeller, which distributes the rock salt out the back of the salt truck onto the road.

The exit ports of conventional salt trucks are typically large chutes through which salt is emitted at a high rate, limiting the amount of control the operator has over the speed and volume of salt distributed. Further, the exit ports are located above the tires of the truck, which means that roads and parking lots need to be cleared of cars in order for salt to be distributed along the area in need.

Accordingly, there is a need for a salt spreader that allows for better control over rock salt distribution, as described herein.

BRIEF SUMMARY OF THE INVENTION

To meet the needs described above and others, the present disclosure provides a salt spreader that allows for better control over rock salt distribution. In the embodiments described herein, a salt spreader includes a bucket having ejection ports and spinner controls below a bottom surface. When the salt spreader is attached to earth moving equipment, the rock salt is distributed from a low elevation so as to be spread easily under parked cars.

By providing augers for controlling the movement of rock salt within the bucket and spinner controls for controlling the distribution of the rock salt, the salt spreader of the present application enables the operator to optimize patterns and density. The operator can control the distance, the density, and the direction of the rock salt distribution from the cab of his vehicle. Further, the low elevation distribution points enable operators to distribute rock salt during all hours of the day, rather than limiting their time until night-time hours or during times that streets are cleared of parked cars.

In one example, the salt spreader includes a bucket with first and second augers positioned in a base of the bucket. Rotation of the first and second augers moves rock salt along the base of the bucket toward first and second ejection ports in a bottom surface of the bucket. First and second spinner controls positioned below the first and second ejection ports, respectively, operate to distribute rock salt away from the salt spreader onto the surrounding area at a width of up to 80 feet.

An attachment mechanism on an exterior of a back surface of the bucket secures the salt spreader to the front of an earth moving equipment such as wheel loader. In a further embodiment, the salt spreader includes a vertically-oriented skid steer plate having an upper lipped edge. During use, a vertically-orientated mount plate of a skid steer is positioned under the lipped surface of the edge.

An object of the invention is to provide a solution to provide for greater control over rock salt distribution distance, density, and direction.

Another object of the invention is to provide a solution to allow for the distribution of rock salt under parked vehicles.

An advantage of the invention is that it creates an additional distributor for rock salt in the construction industry.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
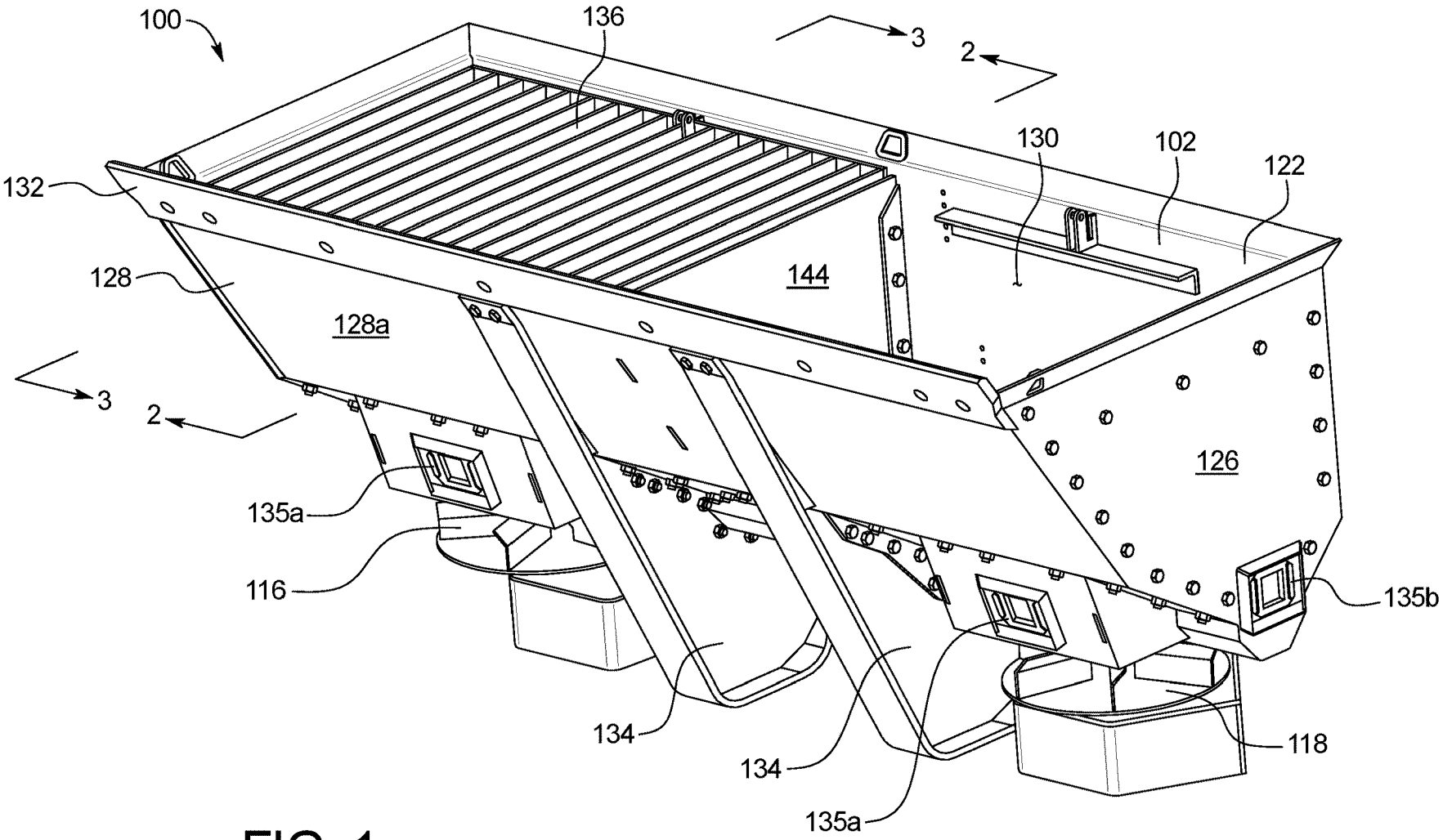
FIG. 1 is an isometric view from above of a first embodiment of a salt spreader of the present application.

FIGS. 1-10 illustrate an example of a salt spreader 100 attachable to earth moving equipment for dispensing and spreading rock salt on a road or other surface. As shown in FIG. 1, the salt spreader 100 includes a bucket 102 with first and second augers 104 (see FIGS. 2 and 6) positioned in a base 108 of the bucket 102. Rotation of the first and second augers 104 moves rock salt along the base 108 toward first and second ejection ports 110, 112 (see FIGS. 6) within a bottom surface 114 of the base 108. First and second spinner controls 116, 118 positioned below the first and second ejection ports 110, 112, respectively, operate to distribute rock salt away from the salt spreader 100 onto the surrounding area. An attachment mechanism (not shown) on an exterior of a back surface 122 of the bucket 102 secures the salt spreader 100 to the front of an earth moving equipment such as wheel loader.

Figure 2:
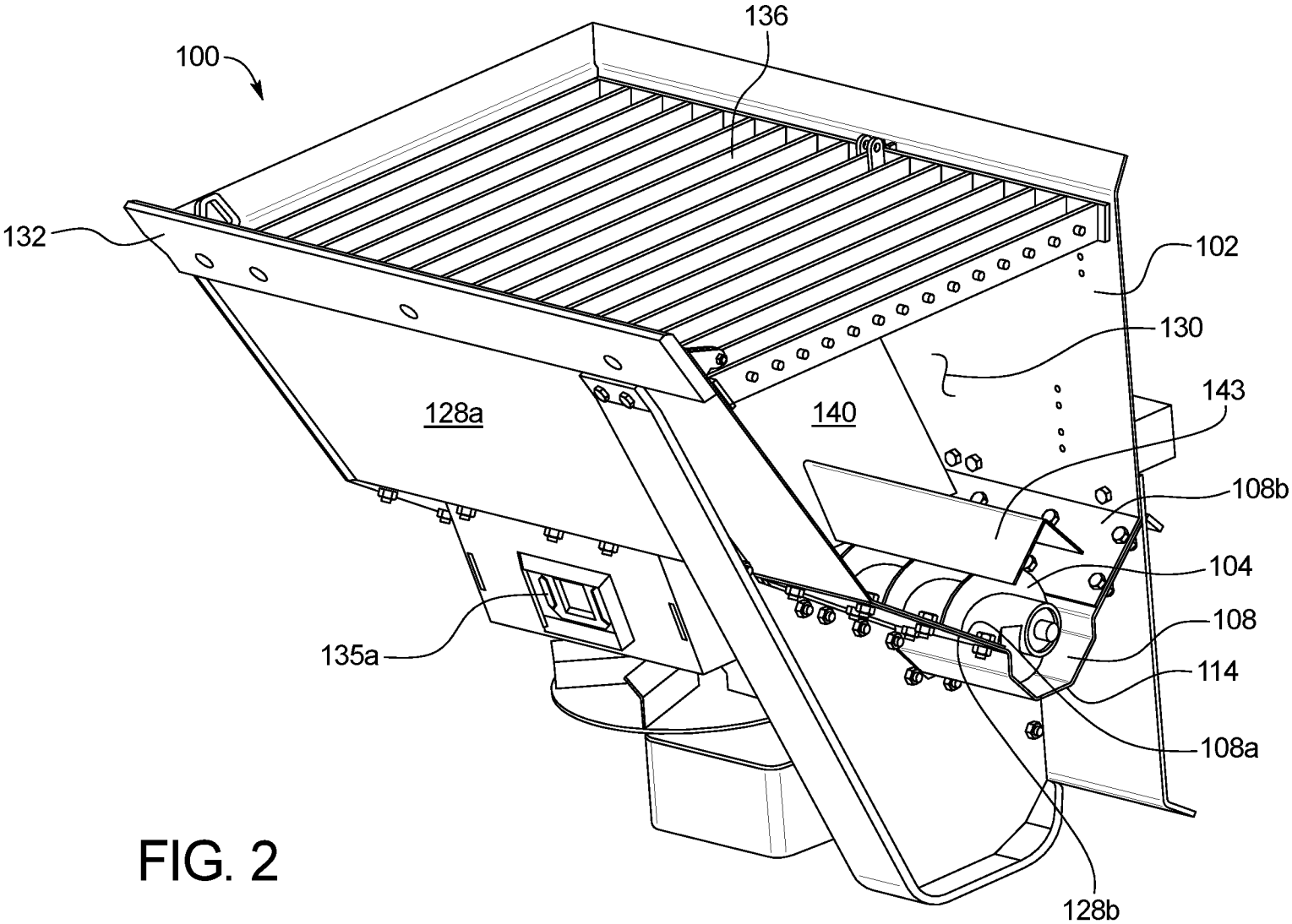
FIG. 2 is a cross-sectional view of the salt spreader of FIG. 1 taken generally along lines 2-2.

As shown in FIGS. 1-10, the bucket 102 includes a back surface 122, first and second side surfaces 124, 126, a base 108 including the bottom surface 114, and a front surface 128 to form the cavity 130. Each of the back and the front surfaces 122, 128 include upper portions 122*a*, 128*a*, respectively, and lower portions 122*b*, 128*b*, respectively, each of which form an obtuse angle. The upper section 122*a* of the rear surface 122 is generally vertical, and the upper section 128*a* of the front surface 128 angles inward toward the cavity 130 of the bucket 102. The lower sections 122*b*, 128*b* provide surfaces onto which front and rear wings 108*a*, 108*b* of the base 108 is anchored, as shown in FIG. 2.

The upper section 122*a* of the rear surface 122 forms approximately 90 degree angles with side surfaces 124, 126. The front surface 128 also includes a front edge 132 that may contact the rock salt mound and/or road during loading of the rock salt. Gussets 134 extend along the height of the front surface 128 to provide additional structural support. The front surface 128 and side surfaces 124, 126 may include one or more indicator lights 135*a* such as strobe lights and/or one or more work lights 135*b* such as LED lights. A salt grate 136 as shown in FIGS. 1-3 is secured within the cavity 130 of the bucket 102 to prevent large objects from entering and damaging the first and second augers 104, 106.

Figure 3:
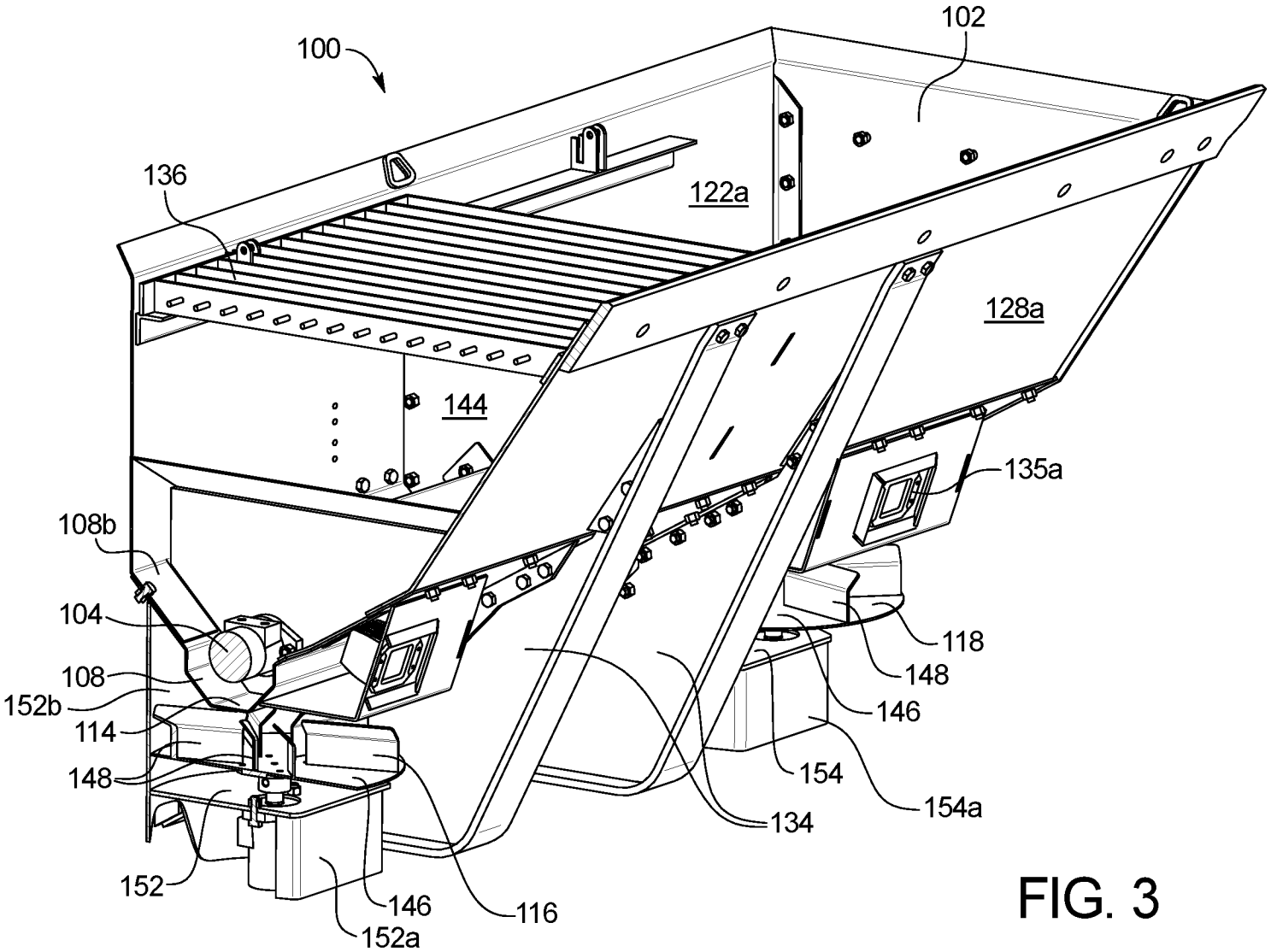
FIG. 3 is a cross-sectional view of the salt spreader of FIG. 1 taken generally along lines 3-3.
Figure 6:
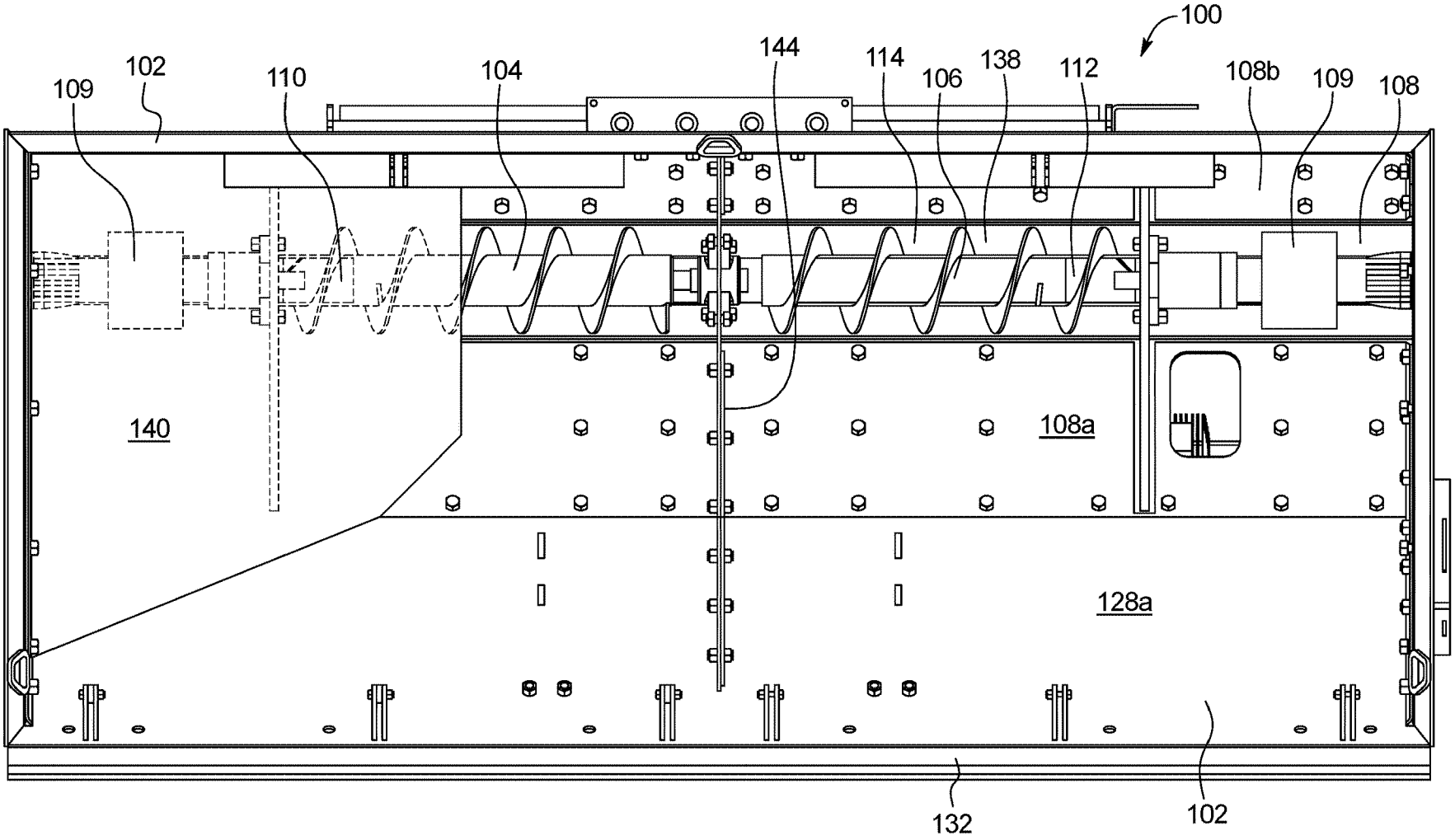
FIG. 6 is a plan view of the salt spreader of FIG. 1 with the grate removed.
Figure 7:
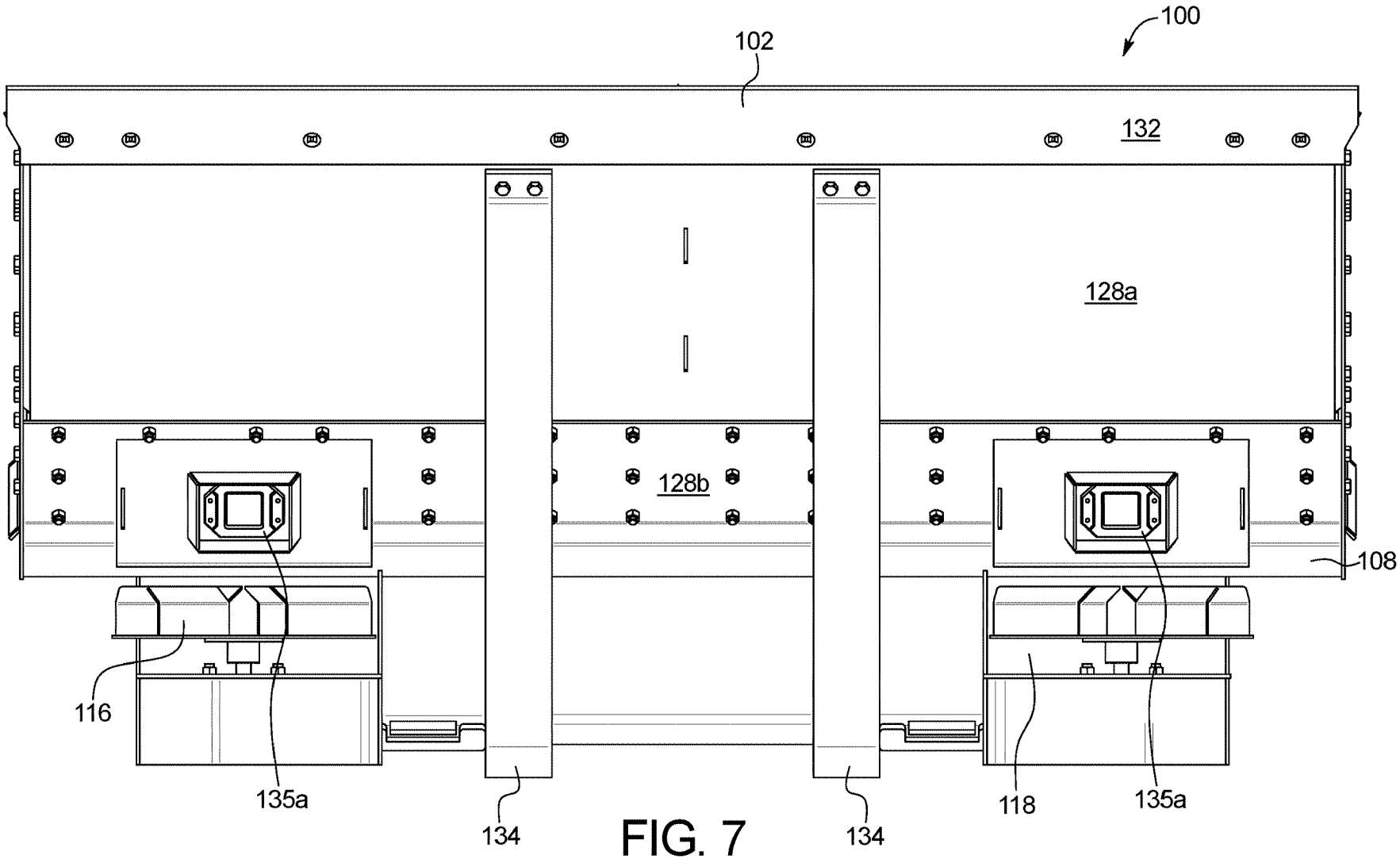
FIG. 7 is a front elevational view of the salt spreader of FIG. 1.
Figure 8:
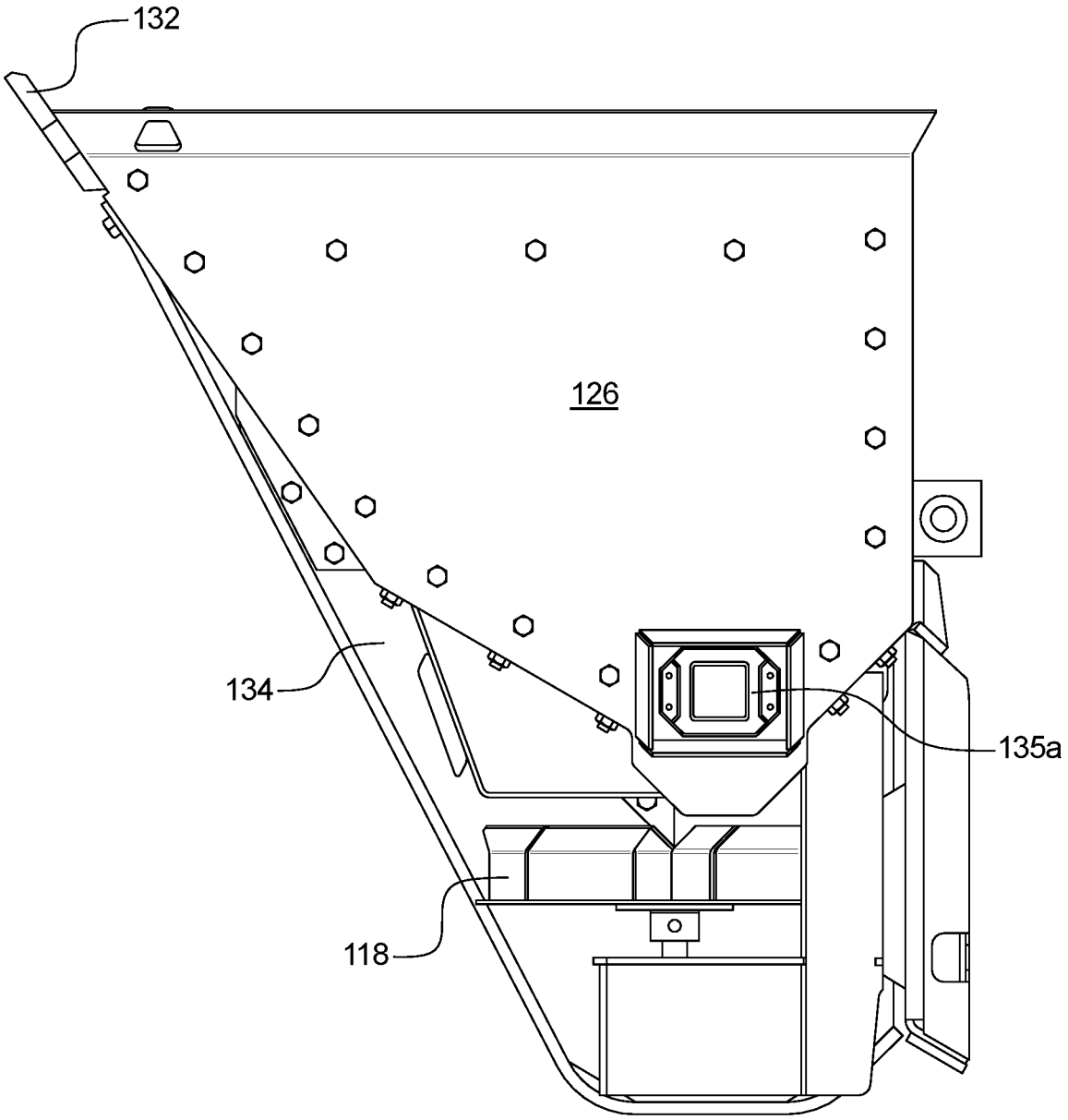
FIG. 8 is a side elevational view of the salt spreader of FIG. 1.
Figure 9:
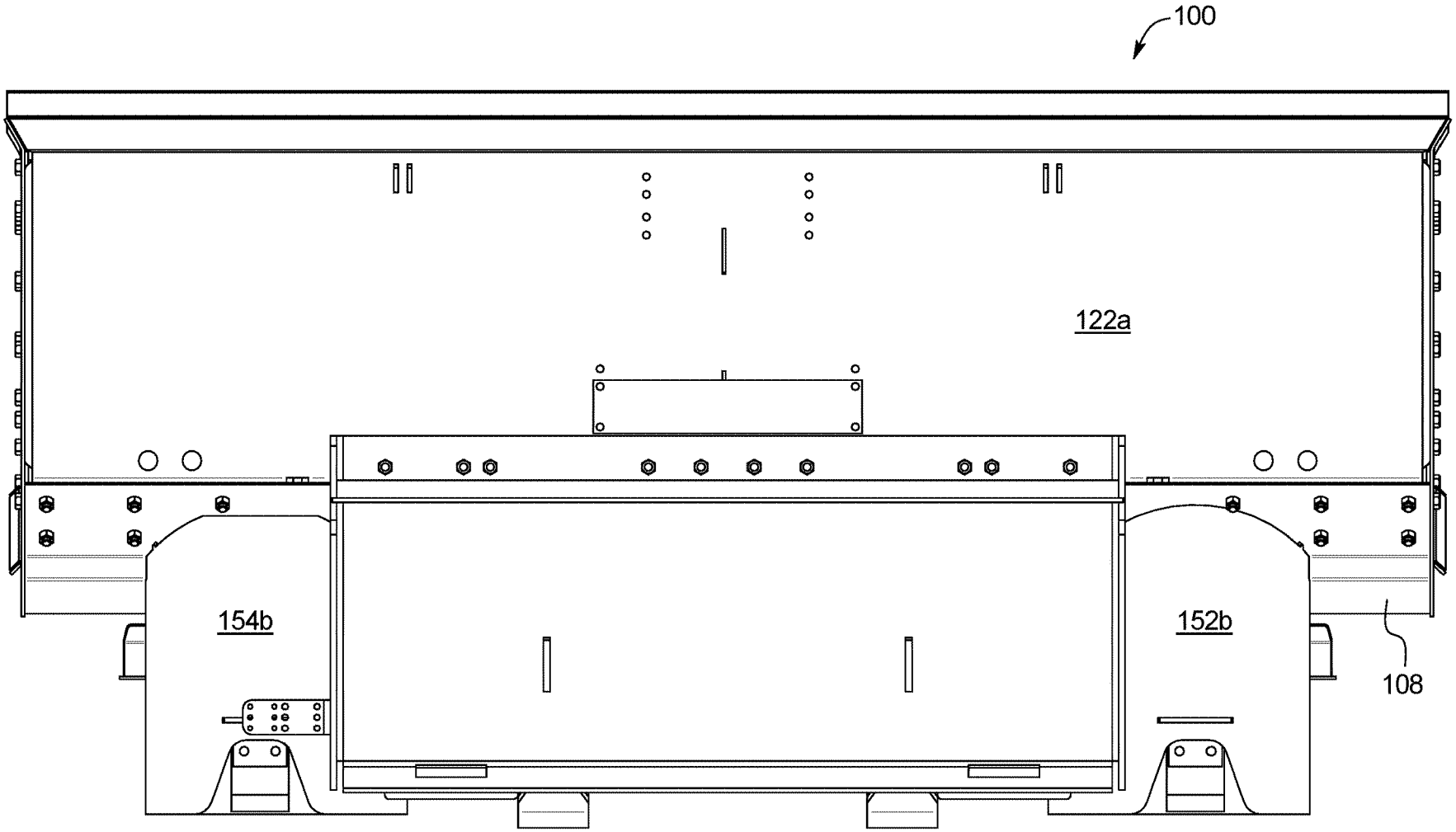
FIG. 9 is a back elevational view of the salt spreader of FIG. 1.
Figure 10:
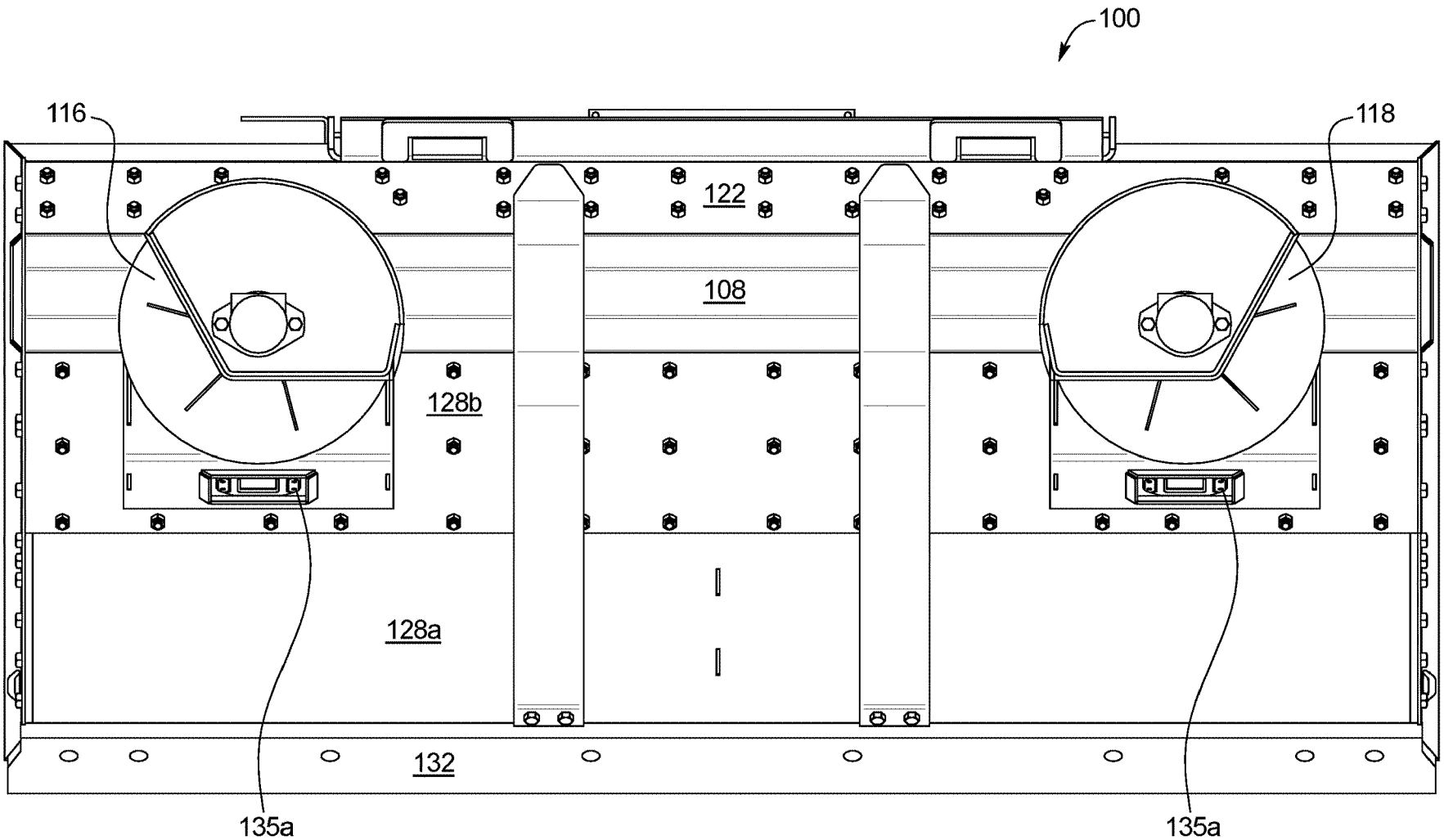
FIG. 10 is a bottom plan view of the salt spreader of FIG. 1.

Each of the first and second augers 104, 106 are positioned within an auger tube 138 along the base 108 of the bucket 102 near the back surface 122 as shown in FIG. 3. First and second motors 109 for operating the first and second augers 104, 106, respectively, are located adjacent to the first and second side surfaces 124, 126, respectively, next to the first and second augers 104, 106, respectively. As shown in FIGS. 1 and 3, first and second motor covers 140 shield the first and second motors, respectively, from rock salt during use. The first and second motor covers 140 extends downwardly from the respective side surface 124, 126 to a centrally-located separator 144 positioned between the first and second augers 104, 106 to direct rock salt toward the auger tube 138 in the base 108. FIG. 6 illustrates the first mount cover 140 while the second mount cover has been removed to illustrate the underlying components.

The first and second augers 104, 106 direct rock salt toward the ejection ports 110, 112 within the bottom surface 114. In other embodiments, the salt bucket 100 includes a single auger 104 that directs rock salt toward one or more ejection ports 110, 112 within the base 108.

Referring to FIG. 2, an auger cover 143 is positioned atop the auger 104 within the cavity of the bucket 102. The auger cover 143 protects the storage of rock salt from piling atop of the auger 104, therefore allowing the auger 104 to rotate and move rock salt along the auger tube 138.

The first and second augers 104, 106 as well as the first and second spinners 114, 116 are controlled independently so that the operator can adjust the density of application of the rock salt as well as the distance that the salt rock is dispersed in each direction.

Rotation of the first and second augers 104, 106 move rock salt collected at the base 108 of the bucket 102 towards first and second ejection ports 110, 112 formed within the bottom surface 114 of the bucket 102. First and second spinner controls 116, 118 are positioned immediately below the first and second ejection ports 110, 112 to receive rock salt after it passes through the ejection ports 110, 112 and to dispense the rock salt radially outwardly as the spinner controls 116, 118 rotate.

Each spinner control 116, 118 includes a bottom plate 146 having a plurality of radially-extending vanes 148. The spinner 118 rotates about a central axis 150 perpendicular to the bottom surface 114 of the bucket 102 during use. The first and second spinner controls 116, 118 are mounted on first and second spreader mounts 152, 154, respectively, that are secured to an exterior surface of the bottom surface 114. Each spreader mount 152, 154 includes a support base 152*a*, 154*a* secured to a wall 152*b*, 154*b* that extends from the rear surface 122, although other means for mounting the spinner 116, 118 to the bucket 102 may be used. In some embodiments, the salt bucket 100 may include first and second spinner shields that direct rock salt toward the side surfaces.

In some embodiments, the first and second spinner controls 116, 118 allow for up to a 40-foot spread, for a total of up to a spread of about 80 feet. The low-elevation of the ejection ports 110, 112 and spinner controls 116, 118 enable for salting under parked cars. The use of conventional salt trucks is typically limited to night-time hours when paved surfaces are clear of cars. The ability to distribute salt under parked cars increases the time available for salting paved surfaces.

Figure 4:
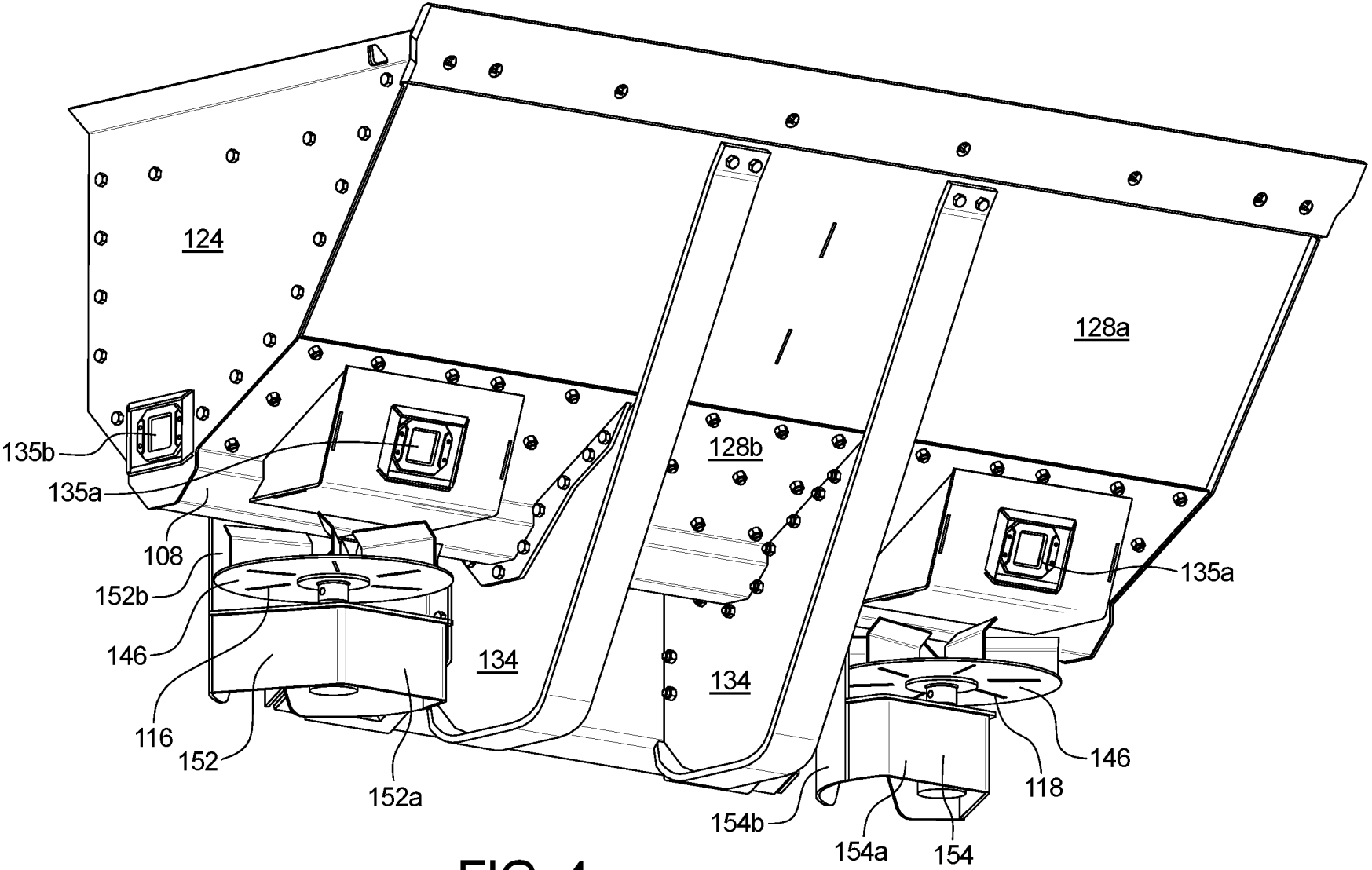
FIG. 4 is an isometric view from below of the salt spreader of FIG. 1.
Figure 5:
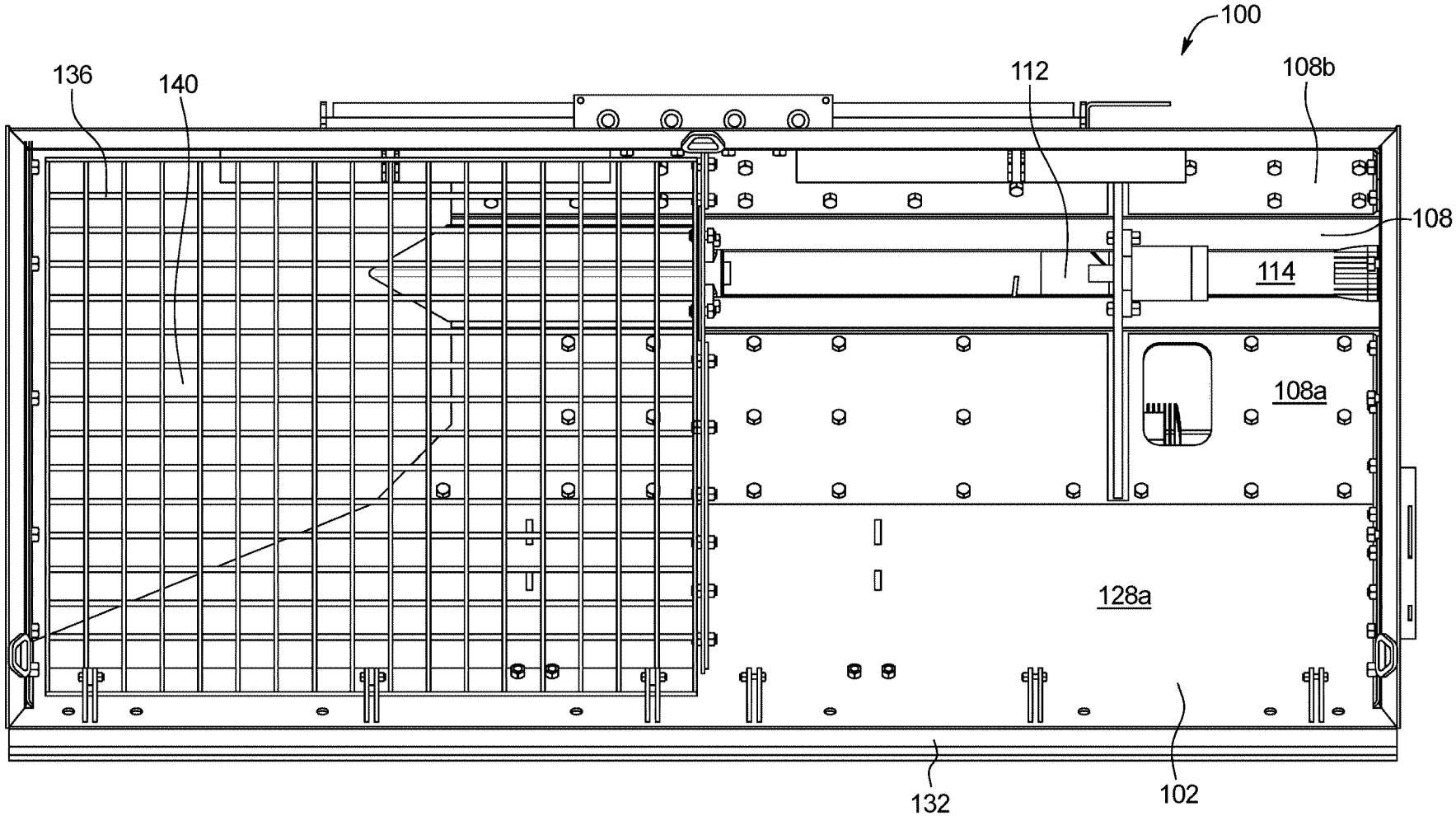
FIG. 5 is a plan view of the salt spreader of FIG. 1 showing internal components.

Referring to FIGS. 3-5, the salt spreader 100 includes an attachment system on an exterior surface of the back surface 122 of the bucket 102. The attachment system may comprise the slip hitch system described in U.S. Pat. Nos. 7,089,692 and 7,658,022, incorporated herein by reference. In other embodiments, the salt spreader 100 may be attached to an earth moving equipment such as a skid steer using a vertically-oriented skid steer plate.

During use, the operator attaches the salt spreader 100 onto the front loader or other earth moving equipment. The operator fills the salt spreader 100 by raising the base 108 of the bucket 102 and lowering the edge 132 of the front surface 130 to a rock salt mound and scooping rock salt into the salt spreader 100.

To distribute rock salt from the salt spreader 100, the operator positions the bucket 102 in an upright position as shown in FIG. 1. Rotation of the first and second augers 104, 106 move the rock salt through the auger tube 138 to the first and second ejection ports 110, 112. Operation of the first and second spinner controls 116, 118 distribute the rock salt by propelling it away from the salt spreader 100. The operator of the earth moving equipment may control the components of the salt spreader 100 using a display panel mounted inside of the cab of the equipment.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A salt spreader for distributing a material comprising:

a bucket including a front surface, a rear surface, and first and second side surfaces, wherein the front and rear surfaces tend toward one another at a base of the bucket, wherein the bucket includes first and second ejection ports in the base;

a separator positioned in a center of the bucket parallel to the first and second side surfaces, wherein the separator is positioned between the first and second ejection ports;

first and second spinner mounts attached to the base of the bucket under the first and second ejection ports, respectively;

first and second spinners rotatably mounted atop of the first and second spinner mounts, respectively;

an auger positioned adjacent to the base of the bucket, wherein the auger rotates to direct salt within the bucket toward at least one of the first and second ejection ports; and first and second covers within the bucket extending downwardly from the first and second side surfaces, respectively, toward the separator, wherein the first and second ejection ports are located under the first and second covers, respectively.

2. The salt spreader of claim 1, further including a motor for operating the auger.

3. The salt spreader of claim 2, wherein the motor is mounted near the base of the bucket.

4. The salt spreader of claim 3, wherein the first and second spinners are configured to control one of density, distance, and direction of distribution of the material.

5. The salt spreader of claim 4, wherein the first and second spinners are configured to control density, distance, and direction of distribution of the material.

6. A method of distributing a material comprising the steps of:

providing a salt spreader comprising:

a bucket including a front surface, a rear surface, and first and second side surfaces, wherein the front and rear surfaces tend toward one another at a base of the bucket, wherein the bucket includes first and second ejection ports in the base;

a separator positioned in a center of the bucket parallel to the first and second side surfaces, wherein the separator is positioned between the first and second ejection ports;

first and second spinner mounts attached to the base of the bucket under the first and second ejection ports, respectively;

first and second spinners rotatably mounted atop of the first and second spinner mounts, respectively;

an auger positioned adjacent to the base of the bucket, wherein the auger rotates to direct salt within the bucket toward at least one of the first and second ejection ports; and first and second covers within the bucket extending downwardly from the first and second side surfaces, respectively, toward the separator, wherein the first and second ejection ports are located under the first and second covers, respectively;

loading the material into the bucket;

rotating the auger to guide the material toward at least one of the first and second ejection ports; and rotating the first and second spinners to direct the material away from the salt spreader.

7. The method of claim 6, wherein the first and second spinners are configured to control one of density, distance, and direction of distribution of the material.

8. The method of claim 6, wherein the first and second spinners are configured to control density, distance, and direction of distribution of the material.

* * * * *